US005409296A

United States Patent [19]

Barile

[11] Patent Number: 5,409,296

[45] Date of Patent: Apr. 25, 1995

[54] ADJUSTABLE LENGTH SUPPORT BASE FOR A SEAT ASSEMBLY

[75] Inventor: Peter Barile, Morristown, Tenn.

[73] Assignee: Shelby Williams Industries, Inc., Morristown, Tenn.

[21] Appl. No.: 254,145

[22] Filed: Jun. 6, 1994

[51] Int. Cl.[6] ..... A47C 1/00

[52] U.S. Cl. ..... 297/344.1; 243/172; 243/501; 297/172

[58] Field of Search ..... 297/344.1, 344.11; 248/172, 501

[56] References Cited

U.S. PATENT DOCUMENTS

| | | | |
|---|---|---|---|
| 406,180 | 7/1989 | Selander . | |
| 520,702 | 5/1994 | Palmberg . | |
| 1,049,159 | 12/1912 | Simmel . | |
| 1,165,880 | 12/1915 | Horton . | |
| 2,553,652 | 10/1947 | Gradle | 297/344.1 |
| 2,589,922 | 3/1952 | Bowman . | |
| 3,392,954 | 7/1968 | Malitte . | |
| 3,542,326 | 11/1970 | Reapsummer . | |
| 4,046,419 | 9/1977 | Schmitt . | |
| 4,560,200 | 12/1985 | Giannelli et al. . | |
| 4,741,506 | 5/1988 | Schwaegerie | 297/344.1 |
| 5,102,192 | 4/1992 | Barile | 248/501 X |

*Primary Examiner*—Peter R. Brown
*Assistant Examiner*—Anthony Barfield
*Attorney, Agent, or Firm*—Silverman, Cass & Singer, Ltd.

[57] ABSTRACT

An adjustable planar sled or support base for a seat assembly which can be selectively adjusted in its length for changing the distance between the seat assembly and a fixed station such as a machine or the like. The planar sled or support base comprises a base plate including a recessed bed opening toward the front end of the support base and an adjustment plate member slidably engaged within the recessed bed and having an end extending outwardly therefrom. The adjustment plate member has a connecting device at the outwardly extending end for anchoring the seat relative to the machine. The adjustment plate member is movable in the bed for adjusting the length of the support base. The base plate includes fasteners to releasably secure the adjustment plate member in the recessed bed to maintain the selected length of the support base.

14 Claims, 2 Drawing Sheets

ADJUSTABLE LENGTH SUPPORT BASE FOR A SEAT ASSEMBLY

FIELD OF THE INVENTION

This invention relates generally to anchoring means for selectively positioning a seat assembly, such as a stool or chair, relative to a fixed station, such as a machine or service station. More particularly, the anchoring means includes a sled or support base for the seat assembly which can be selectively adjusted in its length for changing the distance between the seat assembly and the fixed station.

BACKGROUND OF THE INVENTION

In U.S. Pat. No. 5,102,192 there is disclosed anchoring means for positioning a seat assembly, such as a stool, relative to a fixed station, such as a casino gaming machine 22. The seat assembly was supported on a planar support base or sled which included a quick release connection assembly releasably connecting the planar base in a desired position relative to the gaming machine. In this installed position, the seat assembly was positioned a fixed distance from the gaming machine.

Such installation of the seat assembly at a fixed distance from the gaming machine gave rise to problems when the gaming machines were changed because coin trays, coin acceptance slots and aesthetic design features can vary between different gaming machines. Such a change of the gaming machines can dictate a change in the length of the support base or sled because the space between the player on the seat and the replaced machine is either excessive or insufficient for the player on the seat. In such a situation arising from replacement of the gaming machine, the support base or sled has to be replaced or lengthened. Where the support base has to be replaced so also must the seat assembly be mounted on the new support base.

In some situations, the length of the support bases had to be extended by welding an extension of a fixed length to the bases when the gaming machines were changed. Such an expedient for changing the length of the support base or sled was time consuming and uneconomical, especially where different lengths of extensions were required because of the characteristics of the replacement machines. Once the length of the support base was changed, any subsequent change in its length where replacement of the gaming machines was undertaken, was not a feasible operation as compared to just replacing the support base or sled with one having the necessary length for placing the seat assembly at the desired distance from the gaming machine.

It is desirable, therefore, to provide a support base having a length which is adjustable to selectively position the seat assembly relative to the gaming machines and accommodate changes in the gaming machines. It is also desirable to adjust the length of the support base without the necessity of replacing the support base with a new support base. It is further desirable that the support base permit a range of adjustments and that these adjustments be accomplished rapidly and economically.

SUMMARY OF THE INVENTION

The invention is an adjustable planar sled or support base for a seat assembly which can be selectively adjusted in its length for changing the distance between the seat assembly and a fixed station such as a machine or the like. The planar sled or support base has the seat assembly secured thereon and comprises a base plate including an extremity with a recessed bed opening toward said extremity and an adjustment plate member slidably engaged within the recessed bed and having an end extending outwardly therefrom. The adjustment plate member has connecting means at said outwardly extending end for anchoring said seat relative to the machine. The adjustment plate member is movable in said bed for adjusting the length of the support base. The base plate includes fastener or securement means for releasably securing the adjustment plate member in the recessed bed to maintain the selected length of the support base.

DESCRIPTION OF THE PREFERRED EMBODIMENTS

Figure 1:
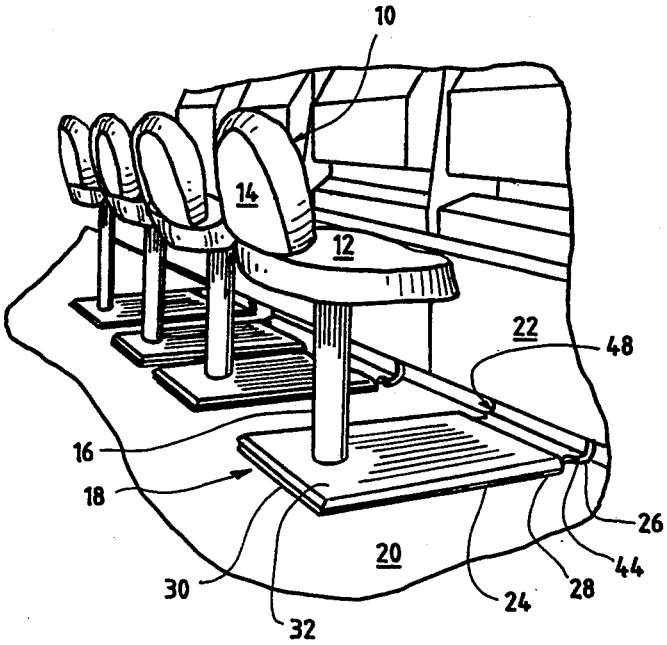
FIG. 1 is a partial perspective view of the anchoring means of the invention illustrating an adjustable sled or support base, a seat assembly mounted thereon and a fixed station such as a gaming machine or the like, the view also illustrating a series of like seating assemblies.
Figure 2:
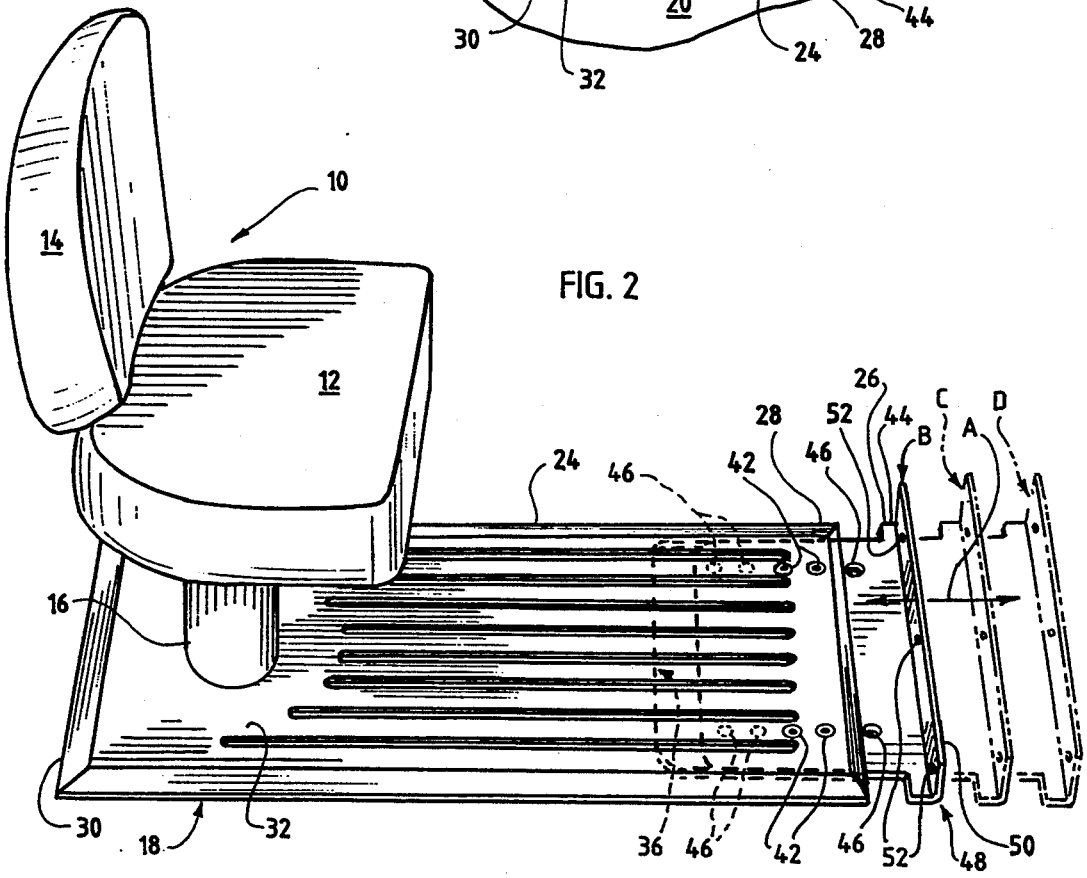
FIG. 2 is a perspective view of the adjustable support base illustrating a single seat assembly, a base plate and a slidable adjustment plate with two possible positions for the adjustment plate illustrated in phantom outline.

Referring to FIGS. 1 and 2, a chair or counter stool is designated generally by the reference numeral 10. The chair 10 preferably includes a seat 12 and a back rest 14 which may or may not be padded. An upstanding pedestal, column or standard 16 supports the chair or stool 10 at its upper end. The standard 16 is mounted upstanding on an adjustable length support base 18 embodying the invention. The support base 18 is substantially planar and is positioned overlying a portion of a substantially planar floor surface 20. The floor 20 can be constructed from any type of material and can include carpeting, if desired. The chair 10 preferably is utilized in conjunction with a fixed station or casino gaming machine 22, such as a slot machine or the like.

The adjustable length support base of the invention generally is designated by the reference numeral 18. The adjustable support base 18 includes a base plate 24 having a slidable adjustment plate 26 for adjusting the length of the support base 18 relative to the gaming machine 22.

Briefly, in operation, the chair 10 is positioned relative to the fixed station 22 by releasably connecting the adjustment plate 26 of the support base 18 to the fixed station 22. The length of the support base 18 and accordingly, the distance between the chair 10 and the fixed station 22 is readily adjusted by selectively positioning and securing the slidable adjustment plate 26 along the path generally indicated by reference arrow "A" seen in FIG. 2.

The base plate 24 of the adjustable length support base 18 preferably is rectilinear in configuration and includes a front end 28 facing toward the fixed station 22, a rear end 30 opposite the front end 28 and an upper surface 32 having the standard 16 secured thereon proximate the rear end 30. The base plate 24 preferably is constructed of metal or the like, although other configurations and constructions may be feasible.

Figure 3:
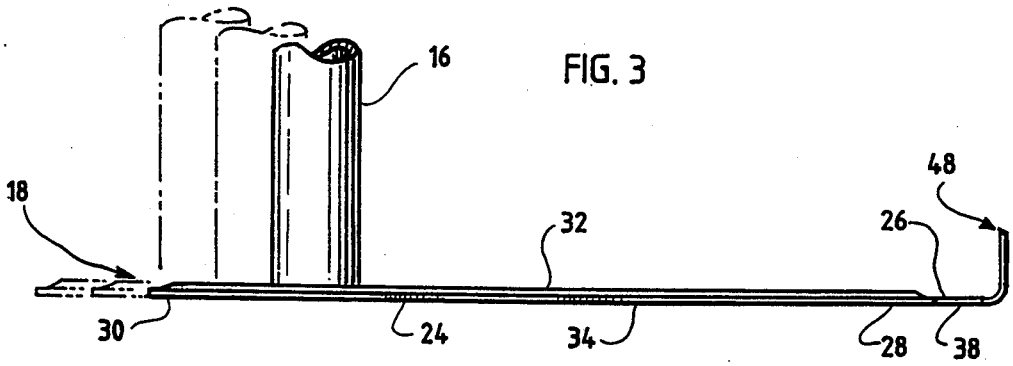
FIG. 3 is a partial side elevational view of the adjustable support base illustrating, in phantom outline, a support member of the seat assembly, the base plate and two possible positions for the seat assembly after adjustment of the length of the support base.
Figure 4:
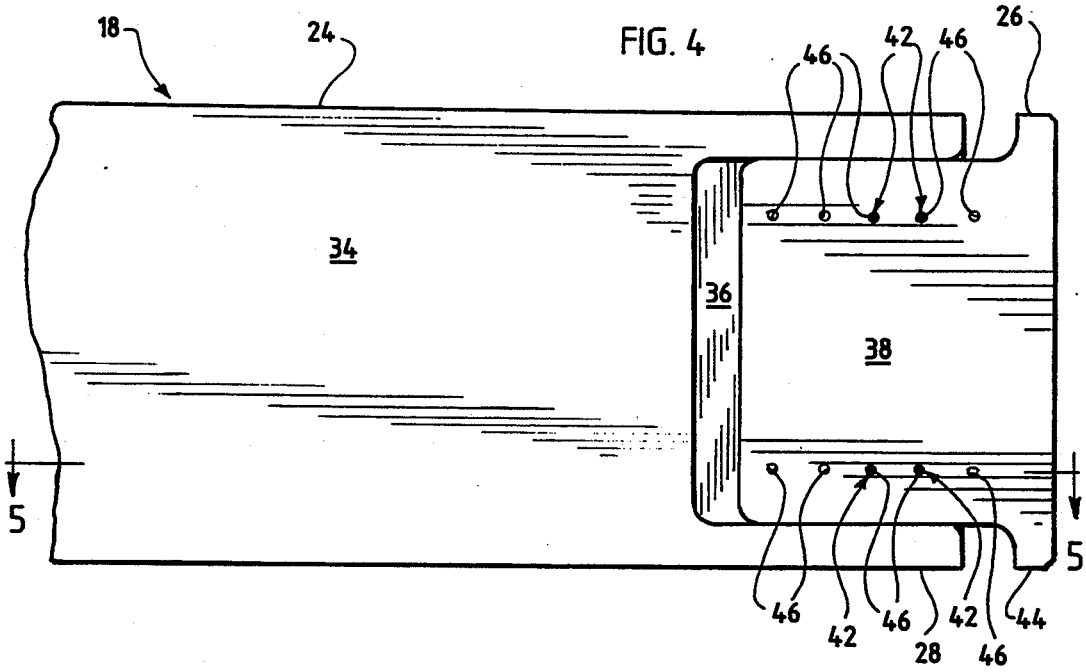
FIG. 4 is a partial bottom plan view of the support base illustrating the base plate a recessed bed and the slidable adjustment plate slidably engaged therein.
Figure 5:
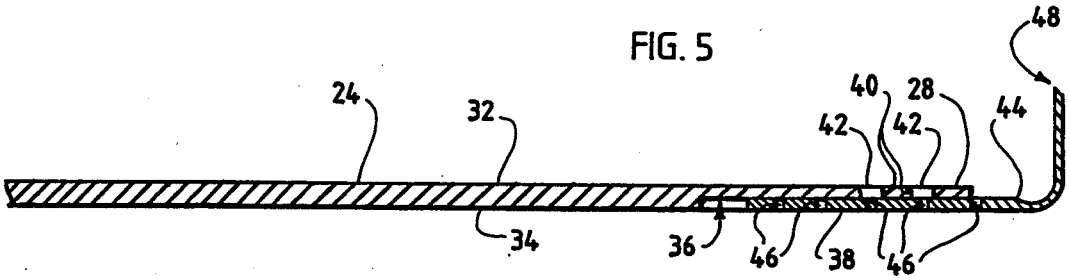
FIG. 5 is a sectional view taken along the line 5—5 of FIG. 4 and in the direction indicated generally.

The base plate 24 further includes an opposite or bottom surface 34 opposite the upper surface 32 as FIG. 3 illustrates. To accommodate the adjustment plate 26 in slidable engagement with the base plate 24 and permit adjustment of the length of the support base 18, the bottom surface 34 is formed with a recessed bed 36 proximate the front end 28 as FIGS. 2, 4 and 5 illustrate. The recessed bed 36 preferably has a width as seen in FIG. 4 dimensioned to guide the adjustment plate 26 as it slides therein and has a depth as seen in FIG. 5 dimensioned such that the bottom surface 34 of the base plate 24 is substantially flush with an adjacent bottom surface 38 of the adjustment plate 26.

In the region of the recessed bed 36, the base plate 24 has a plurality of countersunk securing apertures or sockets 40 extending therethrough between the upper surface 32 and the recessed bed 36 as FIG. 5 illustrates. Referring to FIGS. 2 and 5, the countersunk apertures 40 are adapted to receive fasteners, such as bolts 42 so as to permit securing the adjustment plate 26 within the recessed bed 36 after adjustment of the length of the support base 18, as described more fully herein. Two pairs of the apertures 40 and fasteners 42 preferably are provided although it should be appreciated that the number of apertures 40 and fasteners 42 may vary so long as the adjustment plate 26 remains secured in position within the recessed bed 36 during use. The fasteners 42 preferably are threaded bolts or the like flush mounted in the apertures 40.

As FIGS. 2, 4 and 5 illustrate, the adjustment plate 26 preferably is rectilinear in configuration and is dimensioned complementary to that of the bed 36 so as to be slidably engaged within the recessed bed 36 and flush with the bottom surface 34. Preferably the adjustment plate 26 is constructed of metal or the like, or a suitable combination of other suitable structural materials. The dimensions and configuration of the plate 26 should be complementary to that of the recessed bed 36.

The adjustment plate 26 engages within the recessed bed 36 such that an end or extremity 44 extends outwardly from the bed 36 toward the fixed station 22 as FIG. 1 illustrates. To secure the sliding adjustment plate 26 within the bed 36, the adjustment plate 26 includes apertures or sockets 46 seen in FIGS. 4 and 5 which are adapted to be axially aligned with the securing apertures 40 of the base plate 24 by positioning of selected apertures 46 of the sliding adjustment plate 26 with respect to the securing apertures 40. Each aperture 46 preferably is threaded to receive and engage the fastener 42 inserted through the cooperating securing aperture 40 adjacent thereto.

To vary the distance the end 44 of the adjustment plate 26 extends outwardly from the recessed bed 36, as FIG. 2 generally illustrates, the apertures 46 are provided in a predetermined spaced-apart arrangement seen in FIGS. 2 and 4. The spaced-apart arrangement of the apertures 46 permits ready adjustment of the length of the support base 18 by the selective alignment of the appropriate securing apertures 40 and 46 to position the end 44 of the adjustment plate 26 at a desired location, for example, as indicated generally by arrow "B" or in the alternative, positions illustrated in phantom outline by the arrows "C" or "D".

The positions indicated by arrows "B", "C" and "D" seen in FIG. 2 are governed by the particular apertures 46 in registry with the securing apertures 40 as well as the particular spaced apart arrangement provided. It is recognized that the range of adjustment of the length of the support base 18 may be varied, for example, by varying the lengths of the adjustment plate 26 and the recessed bed 36, the number and spaced apart arrangement of the apertures 46, or the method of securing the adjustment plate 26 relative to the recessed bed 36.

To anchor the chair 10 relative to the fixed station 22, the support base 18 is provided with a connector assembly 48. The connector assembly 48 illustrated in FIG. 2 is formed as an upturned front flange 50 of the outwardly extending end 44 of the slidable adjustment plate 26. The connector assembly 48 includes a plurality of apertures 52 extending through the flange 50 and connects to the fixed station 22 by fasteners (not illustrated) such as bolts or the like. Alternatively, the connector assembly may be of the releasable type disclosed in U.S. Patent 5,102,192. It should be understood that a variety of other suitable fastening or securement means may be utilized for this purpose. In addition, the connector assembly 48 can be utilized to anchor the adjustment plate 26 to a structure other than the fixed station 22 such as a service counter or the like so long as the position of the chair 10 relative to the fixed station 22 is adjustable.

In operation, the support base 18 is positioned adjacent the fixed station 22 and anchored thereto by connecting the connector assembly 48 directly to or proximate the fixed station 22 as seen in FIG. 1. The desired position of the chair 10 relative to the fixed station 22 typically varies depending upon the particular type of fixed station 22 being provided such as a gaming machine or the like. Accordingly, to selectively position the chair 10 relative to the fixed station 22, the length of the support base 18 is adjusted as described herein. It is recognized that adjustment may be performed either prior to or after anchoring of the support base 18 relative to the fixed station 22.

Referring to FIG. 2, adjustment is accomplished by disengaging the fasteners 42 from the apertures 46 of the adjustment plate 26 which permits sliding of the adjustment plate 26 within the recessed bed 36 of the base plate 24 along the path indicated by arrow "A". The adjustment plate 26 is selectively moved to adjust the length of the support base 18 by selectively positioning the outwardly extending end 44, for example, at the position indicated by arrow "B". As FIGS. 4 and 5 illustrate, this selected length of the support base 18 is maintained during use by engaging the fasteners 42 within axially aligned apertures 40 and 46 to secure the adjustment plate 26 and the base plate 24 one with the other.

Alternatively, the adjustment plate 26 also may be selectively moved to position the adjustment plate 26 at alternate positions indicated by arrows "C" or "D" as seen in FIG. 2. The adjustment plate 26 similarly is secured thereat by engaging the fasteners 42 within the particular axially aligned apertures 40 and 46.

Sliding the adjustment plate 26, for example, to the positions indicated by arrows "C" or "D", adjusts the length of the support base 18 to displace the standard 16 and the attached chair 10 inwardly or outwardly as the case may be. Referring to FIG. 3, this displacement of the standard 16 is represented in phantom outline and indicated by reference arrows "E" and "F". In such a manner, the chair 10 may be selectively positioned to accommodate changes in the gaming machines 22 or the like without recourse to a different length unitary base or support plate.

Modifications and variations in the individual structures embodied in the present invention may occur to the skilled artisan in the light of the specification hereof without departing from the scope and spirit of the appended claims.

I claim:

1. A seat assembly adapted to be selectively positioned relative to a fixed station such as a machine or the like comprising:

a seat assembly comprising a seat and a standard, said standard being oriented vertically and said seat being supported on an upper end of said standard;

an adjustable support base having an upper surface and bottom surface, said seat assembly being secured on said upper surface, said support base including a recessed bed in its bottom surface, an adjustment plate member mounted in said recessed bed in surface to surface engagement with said recessed bed, said adjustment member being slidable linearly in said recessed bed to selectively vary said position of said seat relative to said fixed station, said base member and said adjustment member having cooperating fastener means for releasably securing said adjustment member in said recessed bed, said adjustment member including connecting means for anchoring said adjustment member in said recessed bed in fixed position relative to said station.

2. The seat assembly as defined in claim 1 wherein said cooperating fastener means comprise a series of spaced apart and aligned sockets in registry in said support base and adjustment member respectively and multiple fastener members adapted to be engaged in said sockets for rigidly mounting said adjustment member in said bed in varying positions for adjusting the length of the support base whereby the distance of the seat from the fixed station can be varied.

3. The seat assembly as defined in claim 2 wherein said recessed bed is open at one end thereof in a direction facing toward the fixed station, and said adjustment plate member is slidable to a position protruding outwardly through said open end.

4. The seat assembly as defined in claim 3 wherein said connecting means is rigidly secured on said adjustment member and protrudes outwardly from the recessed bed for attachment to said fixed station.

5. The seat assembly as defined in claim 1 in which said recessed bed and length adjustment member have complementary dimensions which enable said adjustment member to be slidably seated in said bed flush with the bottom surface of the support base.

6. In a seat assembly adapted to be selectively positioned relative to a fixed station such as a machine or the like and which includes a seat and a standard in which said standard is oriented vertically and said seat is supported on the upper end of said standard:

an adjustable length support base adapted to have said standard secured upstanding thereon comprising a plate or sled having top and bottom surfaces, front and rear ends, and a recessed bed formed in said bottom surface and opening toward said front end, an adjustment plate member slidably secured in surface-to-surface engagement within said recessed bed and having an extremity extending outwardly at the opening of the recessed bed, said adjustment member being movable relative to said recessed bed to selectively position said extremity a selected distance from said standard, said base member and adjustment member having cooperating securement means for releasably securing said adjustment member in said bed so as to maintain said selected distance between said standard and said end;

and connecting means integrally formed with said extremity of said adjustment member to anchor said support base relative to said fixed station.

7. The seat assembly as defined in claim 6 wherein said cooperating securement means comprise a series of spaced apart and aligned sockets in registry in said support base and adjustment member respectively and fastener members adapted to be engaged in said sockets for mounting said adjustment member in said bed in varying positions for adjusting the length of the support base whereby the distance of the seat from the fixed station can be varied.

8. The seat assembly as defined in claim 7 wherein said recessed bed opens in a direction facing toward the fixed station.

9. The seat assembly as defined in claim 8 wherein said connecting means is rigidly secured on said adjustment member and protrudes outwardly from the recessed bed for attachment to said fixed station.

10. The seat assembly as defined in claim 6 in which said recessed bed and length adjustment member have complementary dimensions which enable said adjustment member to be slidably seated in said bed flush with the bottom surface of the sled.

11. An adjustable length support base for selectively positioning a seat assembly in a desired position with respect to a fixed station such as a machine or the like comprising;

a planar base member having said seat assembly secured upstanding thereon, said base member having top and bottom surfaces, front and rear ends and a recessed bed formed in said bottom surface and opening to said front end;

an adjustment plate member slidably secured within said recessed bed in surface to surface engagement therewith and having an extremity extending outwardly therefrom, said adjustment member being movable relative to said recessed bed to selectively position said extremity for adjusting the length of said support base;

securement means cooperating with said base member and said adjustment member for releasably securing said adjustment member in said bed so as to maintain said length of said support base, said securing means comprising a series of spaced apart and aligned sockets in registry in said support base and adjustment plate respectively and fastener members adapted to be engaged in said sockets for mounting said adjustment member in said bed in varying positions for adjusting the length of the support base whereby the distance of the seat from the fixed station can be varied; and connecting means on said adjustment member to anchor said base member in fixed position relative to said fixed station.

12. The support base as defined in claim 11 wherein said recessed bed opens in a direction facing toward the fixed station.

13. The support base as defined in claim 11 wherein said connecting means is rigidly secured on said adjustment member and protrudes outwardly from the recessed bed for attachment to said fixed station.

14. The seat assembly as defined in claim 11 in which said recessed bed and length adjustment member have complementary dimensions which enable said adjustment member to be slidably seated in said bed flush with the bottom surface of the base member.

* * * * *